US005490493A

United States Patent [19]

Salansky

[11] Patent Number: 5,490,493

[45] Date of Patent: Feb. 13, 1996

[54] MACHINE FOR DELIVERING BALLS, ESPECIALLY TENNIS BALLS

[76] Inventor: Werner Salansky, Reinlgasse 5-9, A-1140 Wien, Austria

[21] Appl. No.: 85,817

[22] Filed: Jul. 6, 1993

Related U.S. Application Data

[63] Continuation-in-part of PCT/AT91/00141, Dec. 30, 1991

[30] Foreign Application Priority Data

Jan. 4, 1991 [AT] Austria ..... 14/91

[51] Int. Cl.[6] ..... A63B 69/40

[52] U.S. Cl. ..... 124/78; 124/82; 124/34; 124/1; 273/26 D

[58] Field of Search ..... 124/1, 80–82, 124/78, 4, 34, 32, 31, 6, 48–50; 273/29 A, 26 D

[56] References Cited

U.S. PATENT DOCUMENTS

| | | | |
|---|---|---|---|
| 4,269,163 | 5/1981 | Feith | 124/77 |
| 4,442,823 | 4/1984 | Floyd et al. | 273/26 D X |
| 4,915,384 | 4/1990 | Bear | 273/26 D X |
| 5,107,820 | 4/1992 | Salansky | 124/78 |
| 5,125,653 | 6/1992 | Kovács et al. | 273/26 D X |

FOREIGN PATENT DOCUMENTS

| | | | |
|---|---|---|---|
| 0400325 | 12/1990 | European Pat. Off. . | |
| 2168883 | 9/1973 | France . | |
| 2945588 | 5/1981 | Germany | 124/78 |
| 90/01975 | 3/1990 | WIPO . | |

*Primary Examiner*—Brian K. Green
*Assistant Examiner*—Harry C. Kim
*Attorney, Agent, or Firm*—Wenderoth, Lind & Ponack

[57] ABSTRACT

A machine for delivering balls, especially tennis balls, has a ball feeder (6) to feed individual balls (5) from a ball magazine (2) to a ball ejector (3) and a machine intrinsic feed controller (30) for sending internal control signals, controlling the ball feed and thus the ejection time, to the ball feeder (6). To enable external synchronization of the ball ejection time of several machines that the machine for delivering balls has a device (33, 35) to deactivate the machine's own feed controller (30) and a control input (34) connected electrically to the ball feeder (6) in order to attach an external control cable (39), by way of which, instead of the internal control signals external control signals, controlling the ball feed, and thus the ejection time, can be fed to the ball feeder (6).

22 Claims, 6 Drawing Sheets

MACHINE FOR DELIVERING BALLS, ESPECIALLY TENNIS BALLS

BACKGROUND OF THE INVENTION

This is a continuation-in-part of International Application PCT/AT91/00141, filed Dec. 30, 1991.

The invention relates to a machine for delivering balls, especially tennis balls, with a ball feeder, feeding individual balls from a ball magazine to a ball ejector. Internal control signals, controlling the ball feed and thus the ejection time, are sent to the ball feeder.

Such machines for delivering bails already exist. The direction, speed and optionally the spin of the ejected ball can be set by adjusting the ball ejector, whereas the machine's own feed controller determines, via control signals to the ball feeder, the ejection time, or in the case of several ejections in succession, the frequency of the ejection sequence.

SUMMARY OF THE INVENTION

The object of the invention is to provide a machine for delivering balls of the aforementioned kind that, in a system of at least two machines for delivering balls, allows balls to be ejected simultaneously from all machines, or allows other machine parameters to be set jointly, such as the velocity of the ball, the direction of the ball, etc. At the same time, however, the machine for delivering balls is supposed to remain totally functional as a single device.

The simultaneous ejection of several balls by means of different machines is of special interest in the training business, where the trainer for several players comments beforehand on each stroke.

This object of the invention is achieved according to one aspect of the invention by a machine for delivering balls having a device to deactivate the machine's own feed controller and a control input connected electrically to the ball feeder in order to attach, preferably detachably, an external control cable, by way of which, instead of internal control signals, external control signals controlling the ball feed and thus the ejection time can be sent to the ball feeder.

The device to deactivate the machine's own feed controller is a device that eliminates control of the ball feeder by means of the machine's own feed controller. In the simplest case this can be a switch in a line leading from the machine's own feed controller to the ball feeder. In this case the machine's own feed controller could even send signals. However, the device to deactivate (the switch) prevents the signals from arriving at the ball feeder. In principle, however, it is also possible to provide a device for deactivation that interacts with the machine's own feed controller in such a manner that the feed controller cannot send any more control signals or simply switches off the machine's own feeder.

When the machine's own feed controller is deactivated, it is possible, by way of the external control cable, which can be attached, preferably detachably to the control input, to send external control signals determining the ball ejection time, instead of the internal control signals. With several machines it is conceivable to provide a separate central unit providing several machines delivering balls with synchronous control signals by Way of a "star-shaped" external control cable. Such an additional control center represents, however, a significant additional expense; and, therefore, it is especially good, according to a preferred embodiment of the invention, if the external control cable on the end opposite the control input of the one machine for delivering balls can be attached to the feed controller of another machine for delivering balls which in the attached state transmits the control signals, controlling the ball feed and thus the ejection time, from the other machine for delivering balls by way of the control input to the ball feeder of the one machine for delivering balls. According to this embodiment, a machine (master machine) can transmit the control signals, controlling the ejection time, from its machine intrinsic feed controller to the machine's own ball feeder and simultaneously to the ball feeder of one or more additional machines for delivering balls (slave machines). Thus, a simultaneous ejection from all of the machines for delivering balls can be controlled without any additional control mechanism.

In the individual machines for delivering balls, the shot setting of the ball ejectors can be adjusted independently of each other. For example, it is possible to set the master machine to far ejection and the slave machine to near ejection, whereby, however, the ejection time is fixed by the master machine.

When the control cable is removed and the machine's own feed controller is activated, the machines for delivering balls according to the invention are also totally functional as single machines.

In principle it is conceivable that the device for deactivating the machine's own feed controller is realized independently of the attachment of the external control cable, for example, by means of a hand operated switch in a line from the machine's own feed controller to the ball feeder. To increase the user friendliness and, above all, to ensure that control signals from the machine's own feed controller and from the external control cable do not arrive simultaneously at the ball feeder, it is especially advantageous according to a preferred embodiment of the invention if the device for deactivating the machine's own feed controller communicates with the control input and automatically deactivates the machine's own feed controller when the external control cable is attached.

Such an automatic deactivation with the attachment of the external control cable can be realized according to a first preferred embodiment if the device for deactivating the machine's own feed controller has an electric relay whose control circuit is connected to the control input and whose switching contact(s) is(are) arranged in an electrical connection between the machine's own feed controller and the ball feeder.

Another preferred embodiment of the invention provides that the device for deactivating the machine's own feed controller has a switch which lies in the electrical connection between the machine's own feed controller and the ball feeder and which is operated by means of the attachment of the external control cable to the control input and thus interrupts the electric connection. With both embodiments it can be ensured in a relatively simple manner that, when the external feed cable is attached, the machine's own feed controller is deactivated, and thus no control signals flow from it to the ball feeder.

A preferred embodiment of the invention provides that the machine for delivering balls has a control output to be attached, preferably detachably, to a control cable, which can be attached to the control input of another machine for delivering balls, whereby the control signals fed to the machine's own ball feeder are applied to this control output. When the machine's own feed controller (master machine)

is activated, the control signals, which are sent from the machine's own feed controller and fix the ball feed and thus the ejection time, are applied to this control output. Thus, a control cable, leading to the control input of another machine for delivering balls, can be attached to this control output. Thus the control signals specified by the first machine for delivering balls can be transmitted to the second machine for delivering balls (slave machine). If the feed controller is, deactivated, as is preferably, automatically the case when the external control cable is attached to the control input, that control signal that is fed to it by way of the control input and the external control cable is applied to the control output of this machine for delivering balls. If another machine for delivering balls is attached to a control output of such a slave machine, then a chain of machines for delivering balls can be formed that eject all of the balls at the ejection time specified by the first machine of the chain.

BRIEF DESCRIPTION OF THE DRAWINGS

Other advantages and details of the invention are explained in detail below with the aid of the drawing figures.

DETAILED DESCRIPTION OF THE PREFERRED EMBODIMENTS

Figure 1:
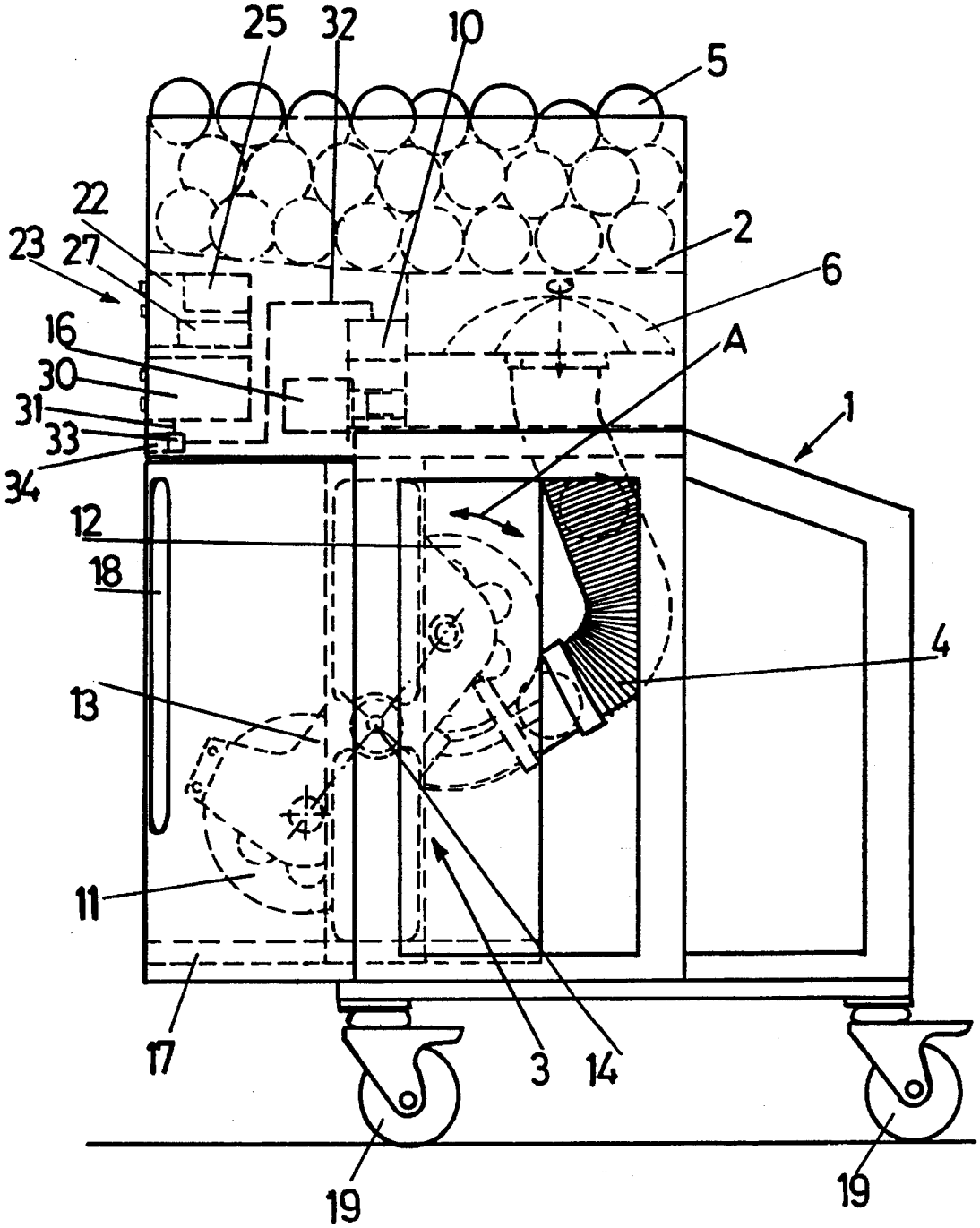
FIG. 1 is a side view, and inpart a sectional view, of a machine for delivering balls.
Figure 2:
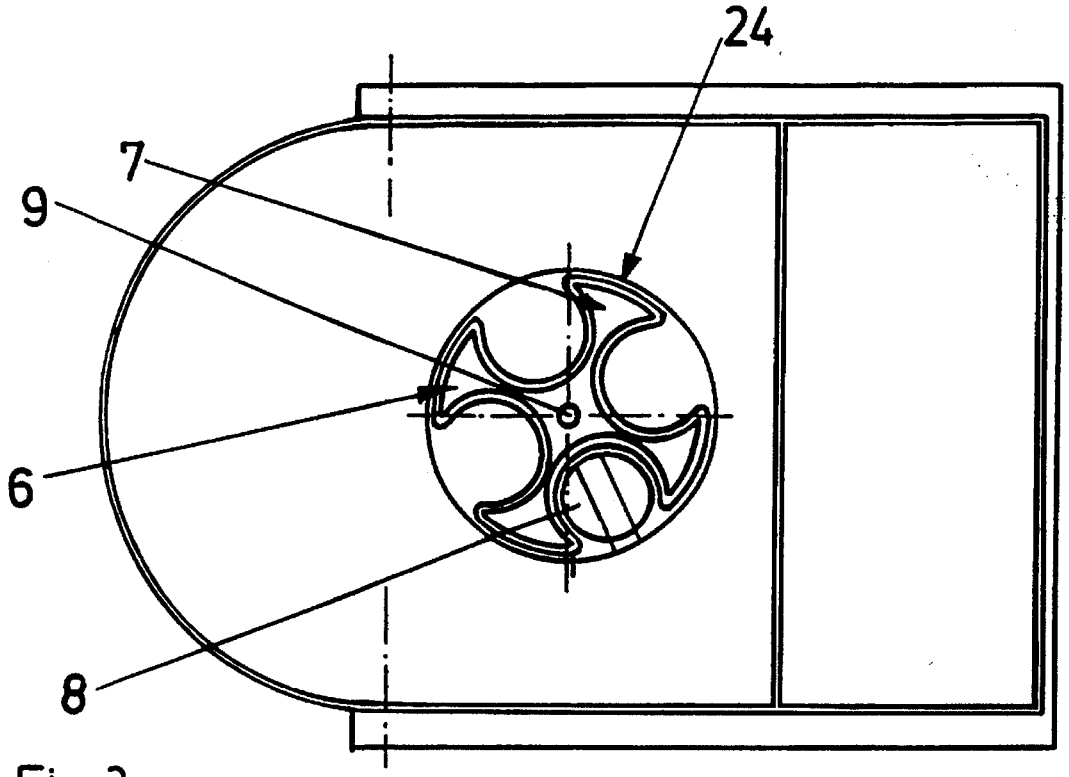
FIG. 2 is a top view of a machine for delivering balls according to the invention.

As apparent from a figures of the drawing, the machine for delivering balls comprises a box 1, where a ball magazine 2 is arranged at the top and the ball ejector 3 is arranged at the bottom.

The ball ejector 3 communicates by way of a hose-shaped feed line, formed by a wire spiral 4, with the ball magazine 2.

The feed of the individual balls 5 from a ball magazine 2 to ball throwing mechanism 3 is controlled in conventional manner by a ball feeder 6, which receives the balls 5 between the arms 7 and feeds the balls individually to an inlet opening 8 of the hose-shape wire spiral 4 and through the wire spiral to the ball ejector 3. The ball feeder 6, which can be rotated around an axis of rotation 9, is driven by means of an electric motor 10. The feeder 6 exhibits the rotatable feed element (driver) as an essential component thereof. To improve the feed, the external surface of the driver has a friction layer 24, which provides for a good drive of the adjacent tennis balls.

The two major parts of the ejector 3 are two rollers 11 and 12. The two rollers 11 and 12 are mounted on a rocker 13. The tilt angle of the rocker 13 in the vertical line, i.e. its swivel in the direction of the arrow A of FIG. 1, is controlled by an electric motor.

The rocker 13 can be rotated at a bearing point 14 around a vertical axis of rotation 15. In so doing, a very large horizontal swivel angle of up to 120° is obtained. The swivel motion is not prevented by the wire spiral 4, forming the feed path for the balls 5.

Figure 3:
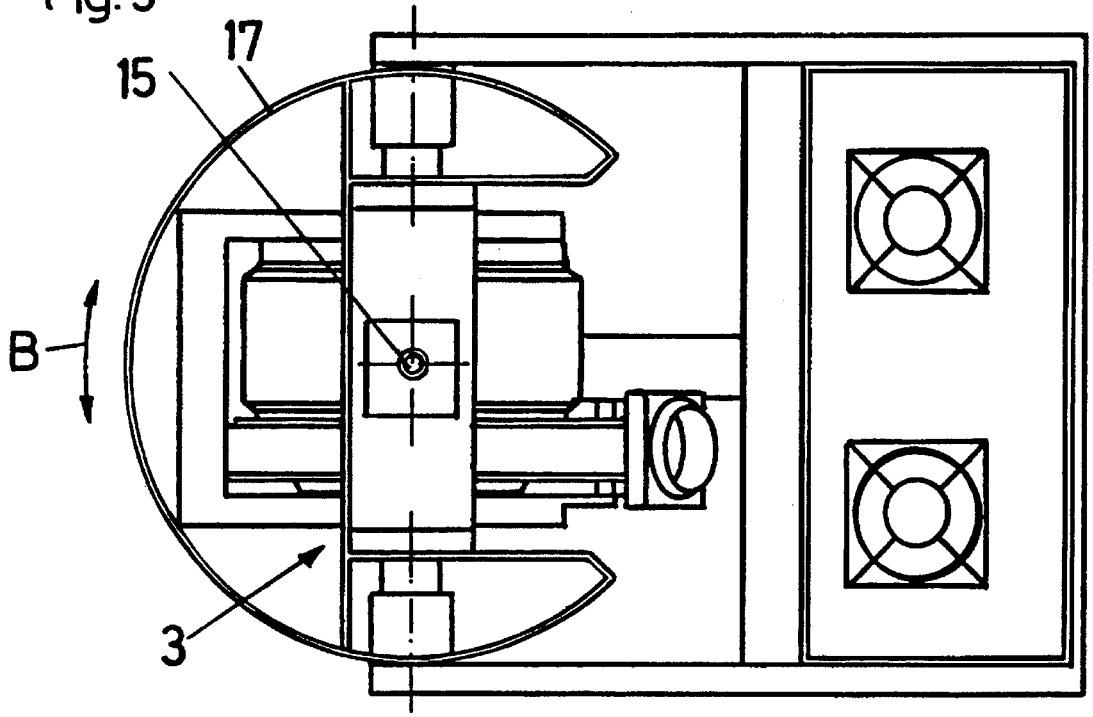
FIG. 3 is a view from the bottom of the machine for delivering balls according to the invention.

The rotation around the axis of rotation 15 in the horizontal line, i.e. in the direction of the arrow B of FIG. 3, is caused by an electric motor 16.

The position of the rocker 13, the angle of rotation around the vertical axis 15 and the velocity of both rollers 11 and 12 define the shot setting of the ball ejector 3 and thus the flight characteristic of the ball that is shot.

The whole ball ejector 3 is enveloped by a cylindrical jacket 17 having an opening 18 for the passage of the balls 5.

The box 1 is provided with rollers 19, but they serve only to transport the machine for delivering balls. While the ejecting mechanism 3 is swivelling, the box remains standing. Only those parts supported by the axis 15 move.

The shot settings of the ball ejector 3 (the control lines leading to the ball ejector are not shown for reasons relating to a better overview) are controlled by an electronic ejection controller denoted in general as 22. Data relating to the shot settings can be stored in a storage device 25, whose content can be modified by way of a keyboard 23 or remote control, whereby each data record corresponds to a specific shot setting or ball flight characteristic. These shot settings can be programmed in a user friendly manner in that not the speed of the roller and the position of the roller, but rather the desired speed of the ball and the direction of the ball, spin, etc., are fed in. The data that are fed in and stored can be displayed via a screen.

The sequence of the now preprogrammed shot settings can be fixed by way of a user programmable sequence controller 27, whereby for training purposes specific balls (shot settings) can also be demanded several times in succession. There is also the option of fixing individually specific shot settings (independently of the preprogrammed shot settings).

To control the ball feed, and thus the ejection time, there is a machine intrinsic feed controller 30, which can send control signals over lines 31 and 32, controlling the ejection time, to the ball feeder 6 or its electric motor 10. According to the invention, a device to deactivate the machine's own feed controller 30 is provided at this stage. In the embodiment shown in FIG. 1 this deactivating device simply comprises switch 33 between the line 31 and the line 32 leading to the electric motor 10. Furthermore, there is a control input 34, which is electrically connected to the ball feeder 6 or its electric motor 10 and to which an external control cable (not shown in detail) can be attached, by way of which, instead of the internal control signals emitted by the machine's own feed controller 3, external control signals, controlling the ball feed and thus the ejection time, can be fed to the ball feeder 6. The control input 34 can be designed, for example, as a socket, into which a generally multipolar plug can be plugged at the end of the external control cable. When the plug is plugged into the socket 34, the switch 33, representing the device for deactivating the machine intrinsic feed controller 30, automatically opens and deactivates the machine intrinsic feed controller 30. Thus, only control signals fed over the external control cable arrive at the ball feeder 6 or its electric motor 10.

Figure 4:
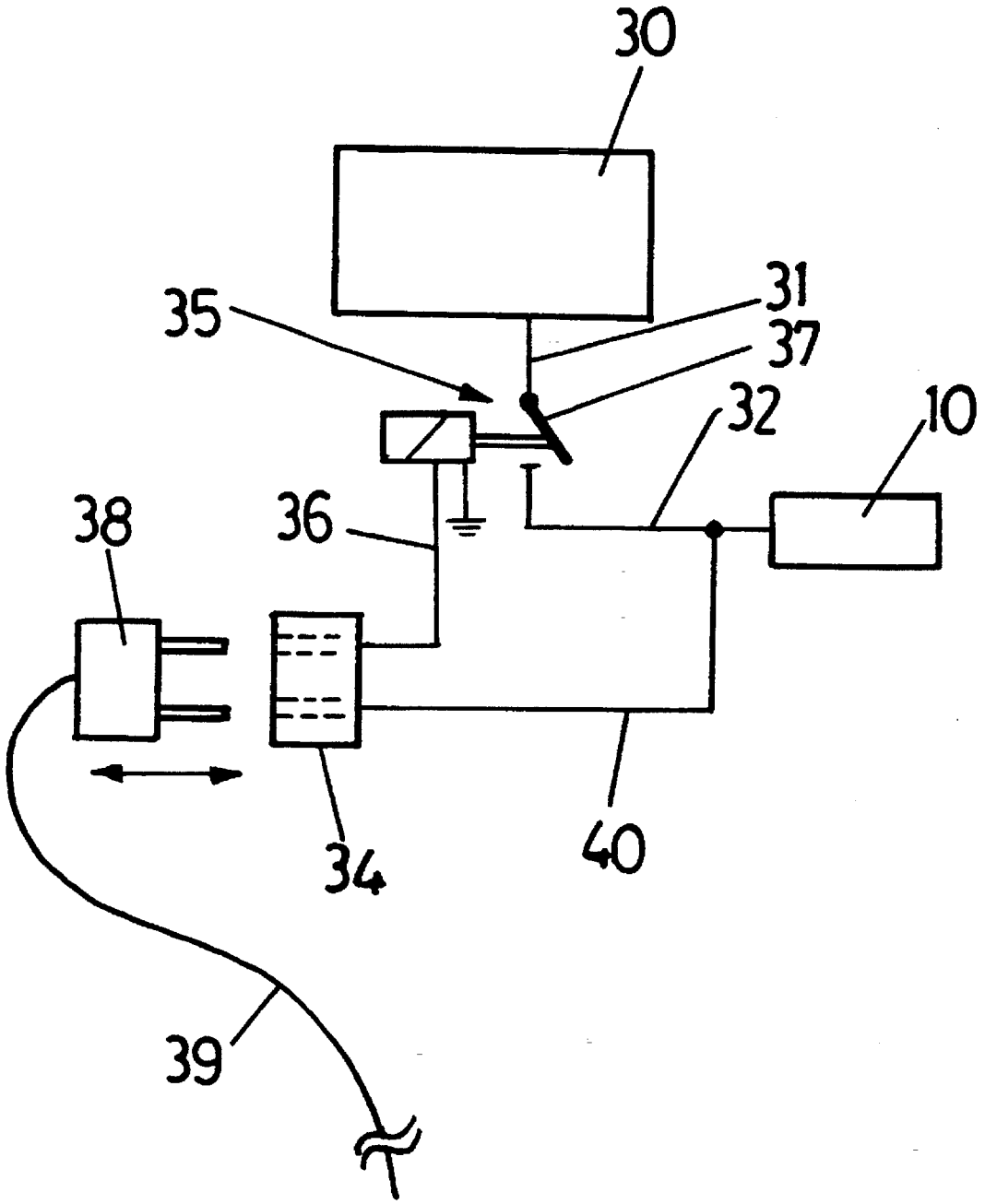
FIG. 4 is a schematic circuit diagram of a device for deactivating the machine's own feeder.

As an alternative to the switch 33, opened mechanically by the plugged in plug of the external control cable, a relay variant shown in FIG. 4 is also possible. There, an electric relay 35 is provided whose control circuit is connected by way of the line 36 to the control input 34 of the machine for delivering balls. A circuit contact 37 of the relay 35 is arranged in the lines 31, 32 leading to the machine's own feeder 6 or its electric motor 10. If a plug 38 of an external control cable 39 is plugged into the control input 34, designed as a socket, then the control circuit of the relay 35 receives, over a line 36, a signal causing the switching contact 37 to open. Control signals transported by the external control cable 39 can then arrive over a line 40 to the electric motor 10 of the ball feeder.

Figure 5:
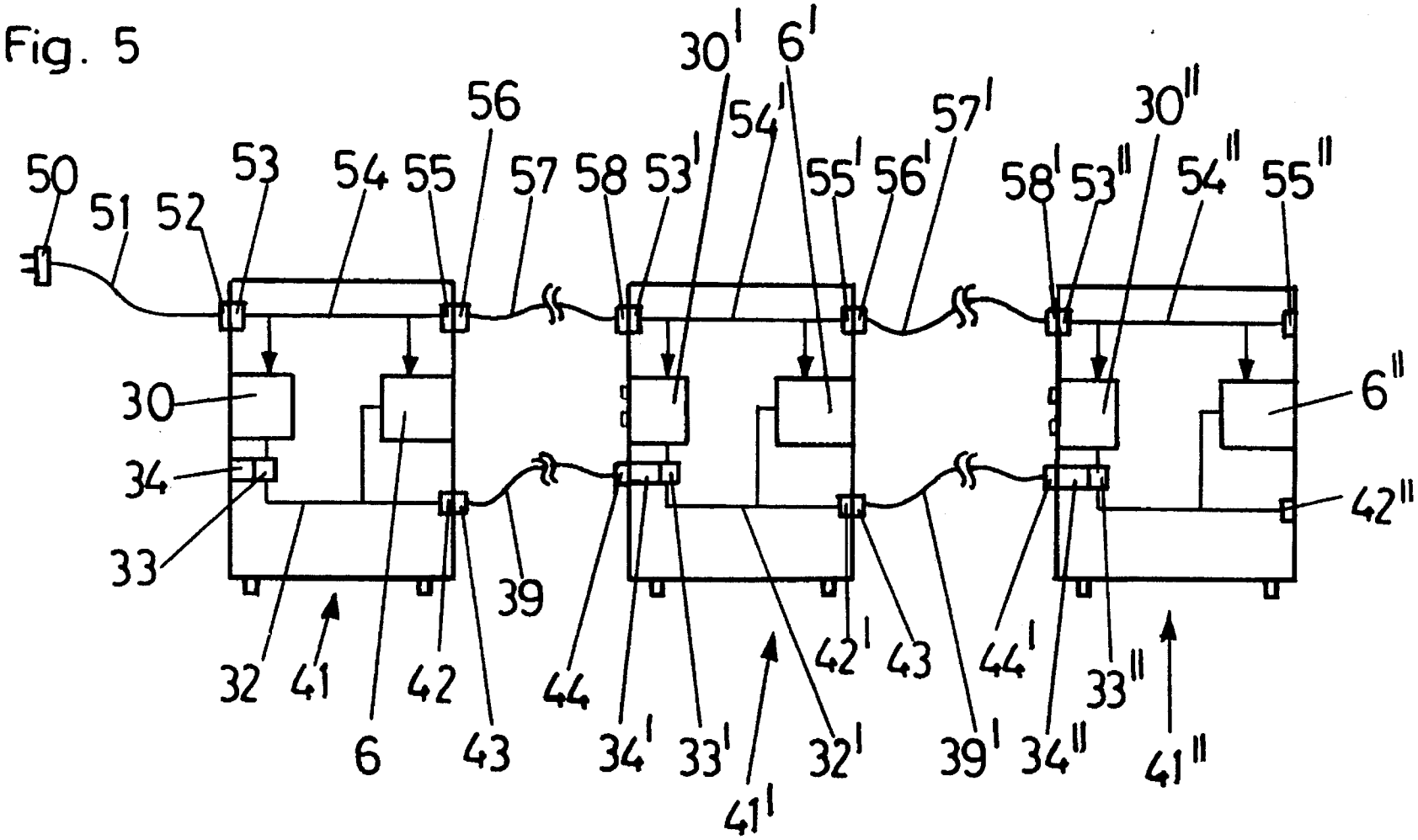
FIG. 5 is a diagrammatic view of three machines connected together.

FIG. 5 is a schematic drawing of three connected machines for delivering balls 41, 41', and 41", where the mechanical parts, especially the ball magazine and the ball ejector, are not shown. The ball feeder 6 is also shown only as a schematic drawing. What is of primary importance in FIG. 5 is how the machines for delivering balls are connected together electrically and how the simultaneous ejection of the balls from all three machines for delivering balls 41, 41', 41" is realized.

The machines for delivering balls shown in FIG. 5 are built identically, and can also be used as totally functional individual machines without electric connection. In the arrangement shown in FIG. 5, the first machine for delivering balls 41 is the master machine, whose machine intrinsic feed controller 30 determines the ejection time of the balls from all three machines for delivering balls. Thus, the attached machines for delivering balls 41' and 41" can be called "slave machines". The slave machines 41' and 41" assume, however, from the master machine 41 only the ejection times; the shot settings, moreover, especially the shot distance of the ball ejector (not illustrated) can be set individually for each machine.

The master machine 41 has a control input 34 that is not used. The device, designed as a switch 33, for deactivating the machine's own feed controller 30 is switched through, so that the machine's own feed controller 30 can send control signals to the ball feeder 6. Moreover, the master machine 41 has a control output 42, to which the the control signals fed to the machine's own ball feeder are also applied. The control output 42 is designed as a socket into which a plug 43, attached to an external control cable 39, can be plugged. The other end of the control cable 39 has a plug 44, which is plugged into a control input 34' of the first slave machine 41'. At this stage the machine's own feed controller 30' of the first slave machine 41' is deactivated by means of the switch 33' attached to the plug 34'. The control pulses which originate from the feed controller 30 of the master machine 41 and are fed over the external control cable 39 and arrive over the line 32' at the ball feeder 6' and the control output 42', designed as the socket. Thus, the first slave machine assumes the ball ejection times of the master machine 41. Similarly the second slave machine 41" assumes, from the control output 42' of the first slave machine 41' over the control cable 39', the control signals determining the ball ejection time. The control output 42" of the second slave machine 41" is not used, but could be used to attach another machine for delivering balls.

The master machine 41 is supplied with power by way of a main power plug 50 and a power supply cable 51, which has a plug 52 which can be attached to an operating current input designed as a socket 53. All of the components of the machine for delivering balls, in particular the ball feeder 6, the feed controller 30 and the ball ejector (not illustrated), are supplied with power over internal lines 54. The internal power line also leads to an operating current output 55, which is also designed as a socket. This socket allows a current supply cable 57 provided with a plug 56 to be attached, whose other end has a plug 58, which can be attached to an operating current input 53' of the first slave machine 41'. Thus, the first slave machine 41' is supplied with power "through" the master machine 41. The second slave machine 41" is supplied with power in an analogous manner.

By running the control cable and the power supply cable as shown in FIG. 5, one can manage with a small number of cables. In addition, the detachable plug connections allow the cable lengths to be adapted to the respective peculiarities and also to vary in a simple manner the number of connected machines for delivering balls. It should also be noted that the control outputs and the operating current inputs and outputs cannot be shown for reasons relating to a better overview, but are also provided in an advantageous manner for this machine. The arrangement of the sockets is shown only as a schematic in FIG. 5, and can be optimized according to varying criteria.

The invention is not limited to the embodiments shown. In particular, another design of the ball feeder is possible. For example, an electromagnetically retractable bolt, which is provided in the feed hose 4, is also conceivable and possible to individually feed the balls from the ball magazine to the ball ejector.

In the aforementioned embodiment, there is the possibility of synchronizing the ejection time among several machines for delivering balls, so that all of the machines for delivering balls eject simultaneously with the time predetermined by the master machine. Naturally, there is also the possibility of jointly fixing for all of the attached slave machines other parameters determining the ejection of the ball from a master machine. Such parameters are, for example, the velocity at which the ball is thrown (throwing distance), the ball spin, the direction of ejection in the horizontal or vertical direction, etc.

Figure 6:
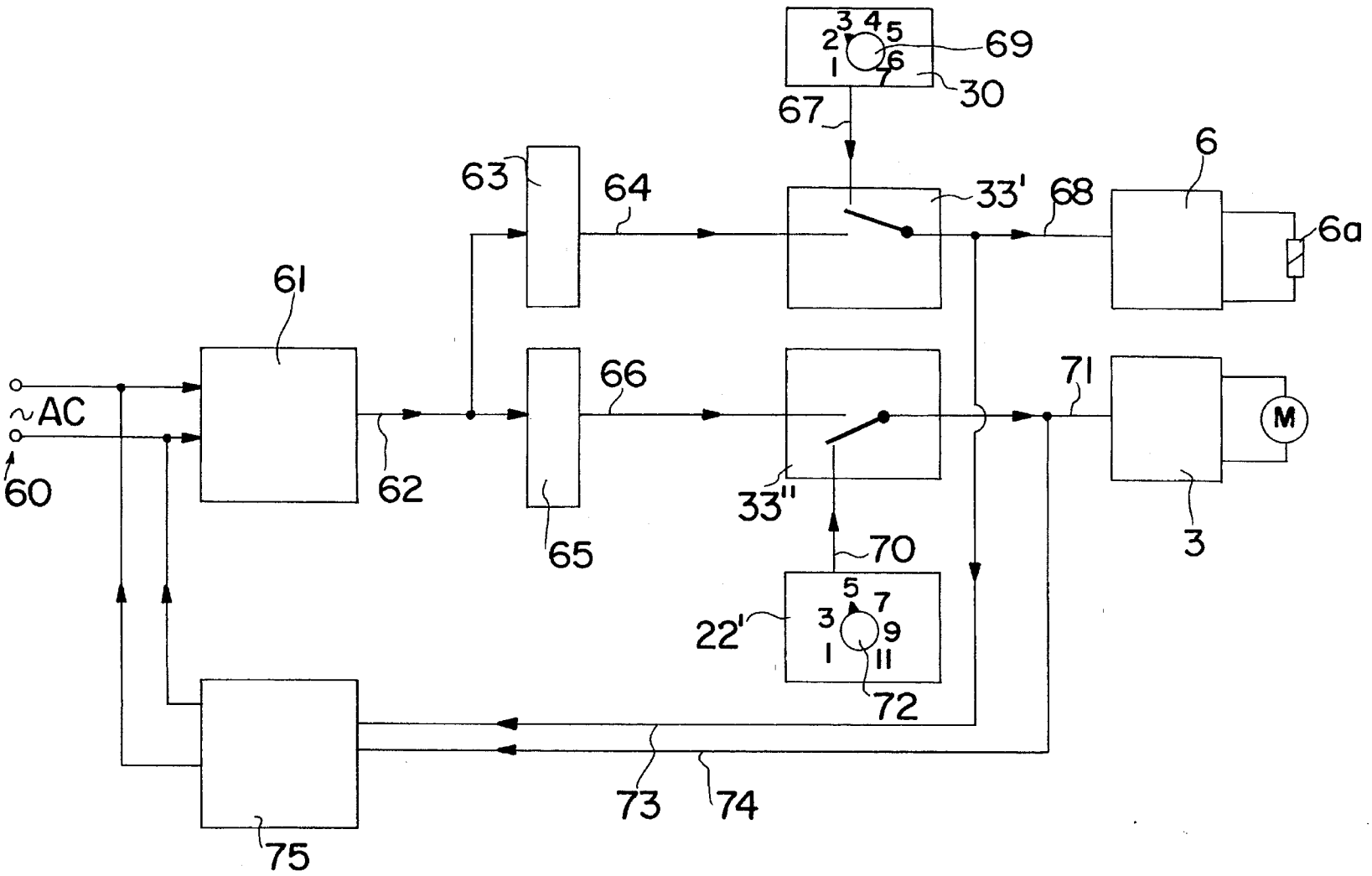
FIG. 6 is a block diagram of a control of another embodiment of the machine for delivering balls according to the invention.

FIG. 6 is a block diagram of an electronic control for a machine for delivering balls with which it is possible to fix jointly not only the ejection time, but also the ejection velocity, of several machines.

In the embodiment shown in FIG. 6 no separate control input for external control signals is provided. Rather, the external control signals are superposed on the main voltage (AC), which is fed over a main connection 60 and a power supply cable (not illustrated in FIG. 6) to the machine. The main voltage itself serves, for example, to drive the motor M of the ball ejector 3. A significantly smaller voltage including the control signal is superposed on this main voltage, which is typically 220 or 110 volts. In a step 61, a low voltage signal that depends on the control signal superposed on the main voltage is given to a line 62. In a step 63 a control signal for the ejection time is sent from this signal over the line 64. In step 65 a control signal defining the velocity at which the ball is ejected is sent from this signal on a line 66. The technology achieved in steps 61, 63, and 65, in particular to superpose control signals on the existing main voltage and then to extract them for the actual control, is well-known to the expert (for example, in duplex systems or remote control of electric apparatuses). For this reason, the steps 61, 63 and 65 do not have to be explained in detail.

If the machine for delivering balls is used with the control shown in FIG. 6 as a single device, change-over switches 33' and 33" stand in the position shown in FIG. 6. The machine's own feed controller 30 sends over lines 67 and 68 control signals to the ball feeder 6. This ball feeder 6 can include, for example, an electromagnet **6*a*, which pulls back a bolt (not illustrated) in a ball feed hose and thus releases the path for the delivery of a ball. Of course, the concrete design of the ball feeder 6 is not relevant. The feed sequence frequency and thus the ejection sequence frequency of the balls can be set in any arbitrary manner by the user by means of an adjusting element (rotating knob 69**).

A controller 22' sends control signals over lines 70 and 71 to the ball ejector in order to control the speed of the motor M and thus the velocity at which the ball is ejected. The user can do this by means of an adjusting element 72 (rotating knob).

In the positions of the change-over switches 33' and 33" in FIG. 6, the external control signals, which may or may not be on the lines 64 and 66, are not observed. If, however, the machine controlled in FIG. 6 is attached to the same main power as another machine for delivering balls of the same kind, then the machine for delivering balls can assume the ball ejection time or the ball ejection speed from this other machine by way of the main connection 60. If only the ball ejection time is to be assumed, the change-over switch 33' is moved from the position shown in FIG. 6 to connect the lines 64 and 68. Thus, the external control signals are sent on the line 64 to the ball feeder 6. The machine's own ball feed controller 30 is ineffective. In this position the machine for delivering balls is a slave machine only with respect to the ball ejection time. However, independently thereof, it is possible to arbitrarily set the velocity at which the ball is ejected. If the ball ejection speed is also to be taken over from the master machine, then the change-over switch 33' is moved out of the position shown in FIG. 6. Thus the external control signals are sent on the line 66 by way of line 71 to the ball ejector 3. The machine's own controller 22' is then ineffective. Thus, the machine is a slave machine both with respect to the ball ejection time and with respect to the ball ejection speed. However, there is also the possibility that the ball ejection time is set independently at each machine and only the ball ejection speed is controlled jointly.

In principle, each machine can also be used as a master machine, because the control signals available on the lines 68 or 71 can be conveyed over lines 73 and 74 to a transmitter 75, which superposes these signals, for example, on a specific higher carrier frequency of the main voltage (AC). When the change-over switches 33' and 33" are in a suitable position, other machines attached to the same power main can assume the settings of the master machine without any additional external control cable.

In practice the rotary knob 69 and the change-over switch 33' can be combined into one module, with the switch 33' normally being in the position shown in FIG. 6, and only when the rotary knob 69 is in the zero position change over into that position can it in which it connects the line 68 to the line 64. Similarly, the rotary knob 72 and the change-over switch 22' can also be combined into one module. If the rotary knobs 69 or 72 are not in the zero position, then it is a master machine that does not take over any external signals. If the rotary knob 69 or 72 is rotated back into the zero position, then the master machine becomes automatically a slave machine that takes over the external control signals from another master machine.

Figure 7:
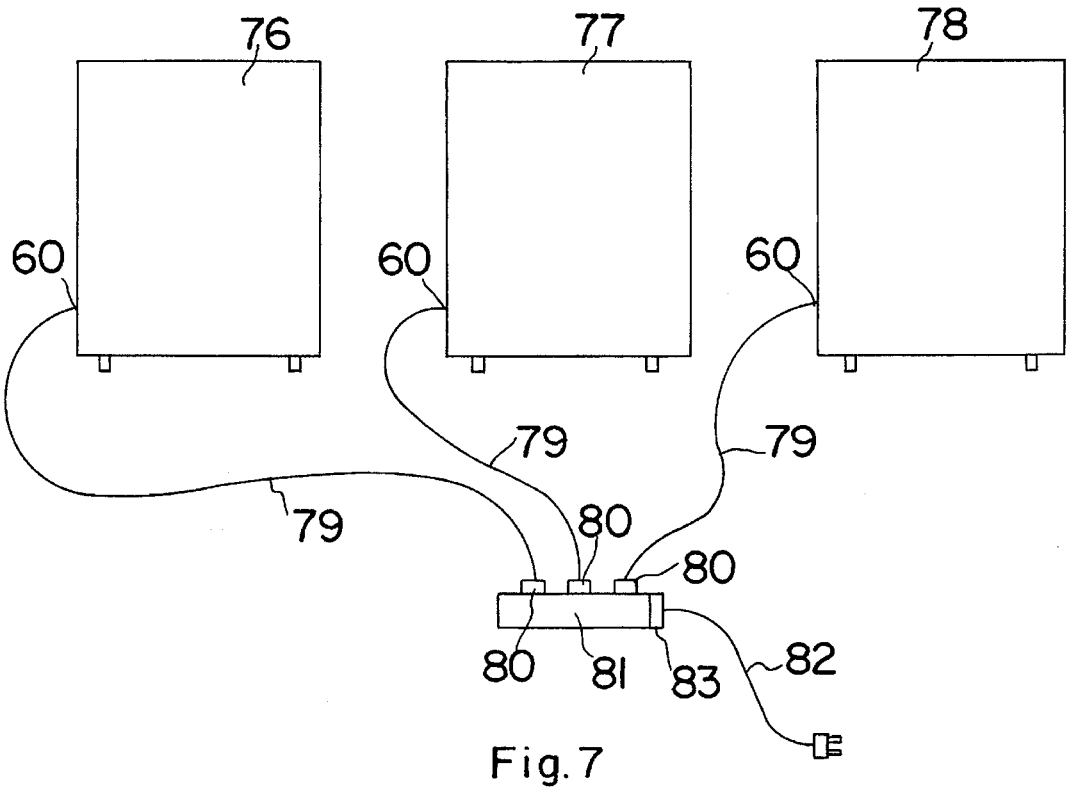
FIGS. 7 and 8 are schematic drawings of three machines connected together.
Figure 8:
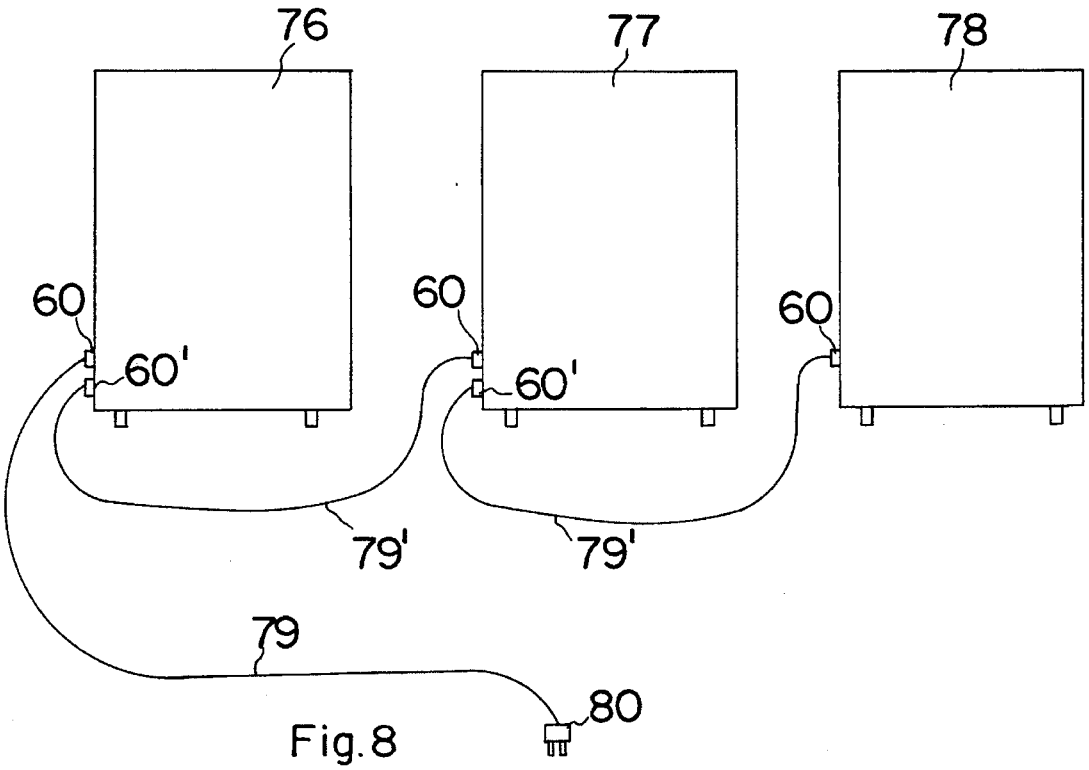

FIGS. 7 and 8 show examples of how three machines 76, 77 and 78 for delivering balls according to the invention can be attached. This is possible by means of a normal main power connecting cable 79, whose plug 80 is plugged into a three-fold distribution socket 81. This three-fold distribution socket 81 can be attached in turn by way of a connecting cable 82 to a socket. So that the control signals superposed on the lines 79 do not get into the normal main, a filtering device 83 can be provided.

In the embodiment shown in FIG. 8 the machines 76, 77 and 78 for delivering balls have two connected main connections 60 and 60'. The second mains connection 60' makes it possible to electrically connect together the machines for delivering balls by way of a connecting cable 79'. On the whole, only one connecting cable 79 with a plug 80 having, for example, a filter to bock the control signals, is necessary to the outside.

I claim:

1. A machine, comprising:

a ball feeder for feeding balls from a ball magazine;

a ball ejector for receiving the balls fed by said ball feeder;

a machine feed controller for sending internal control signals to said ball feeder to control an ejection time of the balls ejected by said ball ejector;

a deactivation device for deactivating said machine feed controller; and a control input electrically connected with said ball feeder that is capable of having an external control cable detachably attached thereto such that external control signals can be fed to said ball feeder controlling the ejection time of the balls ejected by said ball ejector as an alternative to the internal control signals.

2. The machine of claim 1, wherein said deactivation device is connected with said control input such that said machine feed controller is automatically deactivated by said deactivation device when the external control cable is attached to said control input.

3. The machine of claim 2, wherein said deactivation device comprises an electric relay having a control circuit connected to said control input and a switching contact arranged in electrical connection between said machine feed controller and said ball feeder.

4. The machine of claim 2, wherein said deactivation device comprises a switch electrically connected between said machine feed controller and said ball feeder and operable by attachment of the external control cable to said control input to interrupt electrical connection between said machine feed controller and said ball feeder.

5. The machine of claim 4, wherein said control input is a socket and said switch is located at said socket and is operated by a plug being inserted into said socket.

6. The machine of claim 1, and further comprising a control output electrically connected with said machine feed controller.

7. The machine of claim 6, wherein said control output and said control input comprise detachable plug and socket connectors.

8. The machine of claim 7, wherein said detachable plug and socket connectors comprise sockets as said control output and said control input.

9. The machine of claim 1, wherein said control input comprises one of a plug connector and a socket connector.

10. The machine of claim 1, and further comprising an operating current output.

11. The machine of claim 10, and further comprising an operating current input electrically connected with said ball feeder and said ball ejector for supplying operating current thereto, said operating current input having a power supply cable detachably attached thereto, and said operating current output being electrically connected with said operating current input.

12. The machine of claim 11, wherein said operating current input, said operating current output and said power supply cable comprise detachable plug and socket connectors.

13. A system, comprising:

a first ball feeder for feeding balls from a first ball magazine;

a first ball ejector for receiving the balls fed by said first ball feeder;

a first machine feed controller for sending internal control signals to said first ball feeder to control an ejection time of the balls ejected by said first ball ejector;

a deactivation device for deactivating said first machine feed controller; and a control input electrically connected with said first ball feeder that is capable of receiving external control signals to be fed to said first ball feeder for controlling the ejection time of the balls ejected by said first ball ejector as an alternative to the internal control signals;

a second ball feeder for feeding balls from a second ball magazine;

a second ball ejector for receiving the balls fed by said second ball feeder;

a second machine feed controller for sending internal control signals to said second ball feeder to control the ejection time of the balls ejected by said second ball ejector; and an external control cable connected with said second machine controller at one end thereof and connected to said control input electrically connected with the first ball feeder so as to be capable of transmitting control signals from said second machine feed controller to the first ball feeder controlling the ejection time of the balls ejected by the first ball ejector.

14. The system of claim 13, and further comprising a control output electrically connected with said second machine feed controller, said external control cable being attached to said control output.

15. The system of claim 14, wherein said control output, said control input and said external control cable comprise detachable plug and socket connectors.

16. The system of claim 15, wherein said detachable plug and socket connectors comprise sockets as said control input and said control output and plugs on the ends of said external control cable.

17. A machine for delivering balls, comprising:

a ball magazine;

a ball ejector;

a ball feeder for feeding balls from said ball magazine to said ball ejector;

a machine controller for providing internal control signals to said ball ejector and said ball feeder;

at least one external control input for providing external control signals to at least one of said ball ejector and said ball feeder as an alternative to the internal control signals; and a change-over switch between said machine controller, said at least one external control input and said ball feeder for selectively switching said ball feeder between being connected with said machine controller and said external control input.

18. A machine for delivering balls, comprising:

a ball magazine;

a ball ejector;

a ball feeder for feeding balls from said ball magazine to said ball ejector;

a machine controller for providing internal control signals to said ball ejector and said ball feeder;

at least one external control input for providing external control signals to at least one of said ball ejector and said ball feeder as an alternative to the internal control signals; and a change-over switch between said machine controller, said at least one external control input and said ball ejector for selectively switching said ball ejector between being connected with said machine controller and said external control input.

19. A machine for delivering balls, comprising:

a ball magazine;

a ball ejector;

a ball feeder for feeding balls from said ball magazine to said ball ejector;

a machine controller for providing internal control signals to said ball ejector and said ball feeder; and at least one external control input for providing external control signals to at least one of said ball ejector and said ball feeder as an alternative to the internal control signals;

wherein said machine controller comprises an adjusting element having one position at which said at least one external control input is connected with said at least one of said ball ejector and said ball feeder to provide the external control signals thereto and having other positions at which said machine controller is connected with said at least one of said ball ejector and said ball feeder to provide respective different internal control signals thereto.

20. A machine for delivering balls, comprising:

a ball magazine;

a ball ejector;

a ball feeder for feeding balls from said ball magazine to said ball ejector;

a machine controller for providing internal control signals to said ball ejector and said ball feeder;

at least one external control input for providing external control signals to at least one of said ball ejector and said ball feeder as an alternative to the internal control signals; and at least one main power supply connection electrically connected with at least one of said ball ejector and said ball feeder for supplying main power thereto, wherein said at least one main power supply connection forms said at least one external control input, whereby the external control signals can be superposed on main voltage supplied to said at least one main power supply connection.

21. The machine of claim 20, wherein a receiver has an input connected to said at least one main power supply connection for receiving relatively high voltage and an output for providing a control signal of a relatively low voltage.

22. The machine of claim 20, and further comprising a transmitter for superposing a control signal from said machine controller onto the main voltage supplied to said at least one main power supply connection.

* * * * *